US010743126B2

(12) United States Patent
Fontana et al.

(10) Patent No.: US 10,743,126 B2
(45) Date of Patent: Aug. 11, 2020

(54) METHOD AND APPARATUS FOR CONTROLLING ACOUSTIC SIGNALS TO BE RECORDED AND/OR REPRODUCED BY AN ELECTRO-ACOUSTICAL SOUND SYSTEM

(71) Applicants: Huawei Technologies Co., Ltd., Shenzhen (CN); UNIVERSITY OF PARMA, Parma (IT)

(72) Inventors: Simone Fontana, Munich (DE); Angelo Farina, Parma (IT)

(73) Assignees: Huawei Technologies Co., Ltd., Shenzhen (CN); University of Parma, Parma (IT)

( * ) Notice: Subject to any disclaimer, the term of this patent is extended or adjusted under 35 U.S.C. 154(b) by 0 days.

(21) Appl. No.: 16/388,592

(22) Filed: Apr. 18, 2019

(65) Prior Publication Data

US 2019/0246228 A1 Aug. 8, 2019

Related U.S. Application Data

(63) Continuation of application No. PCT/EP2016/075033, filed on Oct. 19, 2016.

(51) Int. Cl.
*H04S 7/00* (2006.01)
*H04R 29/00* (2006.01)

(52) U.S. Cl.
CPC ..... *H04S 7/301* (2013.01); *H04R 29/001* (2013.01); *H04R 2499/13* (2013.01); *H04S 2400/01* (2013.01); *H04S 2400/15* (2013.01)

(58) Field of Classification Search
CPC .. H04S 7/301; H04S 2400/01; H04S 2400/15; H04R 29/001; H04R 2499/13
(Continued)

(56) References Cited

U.S. PATENT DOCUMENTS 8,682,652 B2 * 3/2014 Herre ..... G10L 19/22 704/200.1
8,965,004 B2 2/2015 Scopece et al.
(Continued)

FOREIGN PATENT DOCUMENTS

EP 1001652 A2 5/2000
EP 2478715 B1 7/2013

OTHER PUBLICATIONS

Kirkeby et al. "Design of Cross-talk Cancellation Networks by using Fast Deconvolution," 106th AES Convention, Munich, Germany (May 8-11, 1999).
(Continued)

*Primary Examiner* — William A Jerez Lora
(74) *Attorney, Agent, or Firm* — Leydig, Voit & Mayer, Ltd.

(57) ABSTRACT

The present disclosure relates to a method and to an apparatus, both arranged for controlling acoustic signals to be recorded or reproduced by an electro-acoustical sound system. An initial digital filter is determined by solving an inverse problem, wherein the initial digital filter is configured to control acoustic signals to be recorded and/or reproduced by the electro-acoustical sound system; a frequency-dependent articulation parameter is determined by executing a time spectral psychoacoustic automatic audio quality test on the initial digital filter; a frequency-dependent regularization parameter, used for determining the initial digital filter, is tuned by use of the frequency-dependent articulation parameter; and, by use of the tuned frequency-dependent regularization parameter, a digital filter configured to control acoustic signals to be recorded or reproduced by the electro-acoustical sound system is determined.

20 Claims, 5 Drawing Sheets

(58) Field of Classification Search
USPC ..... 381/56, 58, 94.1, 94.2, 98
See application file for complete search history.

(56) References Cited

U.S. PATENT DOCUMENTS

| | | | | |
|---|---|---|---|---|
| 8,976,979 | B2 * | 3/2015 | Crockett | G11B 20/10527 381/119 |
| 9,949,053 | B2 * | 4/2018 | Grosche | H04S 1/002 |
| 10,299,057 | B2 * | 5/2019 | Wu | G10K 11/175 |
| 2015/0223004 | A1 * | 8/2015 | Deprez | H04S 7/301 381/303 |

OTHER PUBLICATIONS

Kahana et al. "A Multiple Microphone Recording Technique or the Generation of Virtual Acoustic Images," J. Acoust. Soc. Am., vol. 105, No. 3, pp. 1503-1516 (Mar. 1999).
Kirkeby et al. "Fast Deconvolution of Multichannel Systems Using Regularization," IEEE Transductions on Speech and Audio Processing, vol. 6, No. 2, pp. 189-194, Institute of Electrical and Electronics Engineers—New York, New York (Mar. 1998).
Nelson, Philip A. "Active Control of Acoustic Fields and the Reproduction of Sound," Journal of Sound and Vibration, vol. 177, No. 4, pp. 447-477 (1994).
Kirkeby et al. "Analysis of Ill-Conditioning of Multi-Channel Deconvolution Problems," Proc. 1999 IEEE Workshop on 4pplications of Signal Processing to Audio and Acoustics, New Paltz, New York, pp. 155-158, Institute of Electrical and Electronics Engineers—New York, New York (Oct. 17-20, 1999).
Azzali et al. "AQTtool an Automatic Tool for Design and Synthesis of Psychoacoustic Equalizers," 114th AES Convention, Amsterdam, the Netherlands (Mar. 22-25, 2003).
Farina et al. "AQT—a New Objective Measurement of the Acoustical Quality of Sound Reproduction in Small Compartments," 110th AES Convention, Amsterdam, the Netherlands (May 12-15, 2001).
Kim et al., "Optimal regularisation for acoustic source reconstruction by inverse methods," Elsevier Ltd, Journal of Sound and Vibration 275, pp. 463-487 (2004).
Yoon et al., "Estimation of Acoustic Source Strength by Inverse Methods: Part II, Experimental Investigation of Methods for Choosing Regularization Parameters," Journal of Sound and Vibration 233(4), pp. 669-705 (2000).
Nelson et al. "Estimation of acoustic source strength by inverse methods: part i, conditioning of the inverse problem," Journal of Sound and Vibration 233(4), pp. 643-668 (2000).
Kirkeby et al., "Design of Cross-talk Cancellation Networks by using Fast Deconvolution," Presented at the 106th Convention, Munich,Germany, Audio Engineering Society (May 8-11, 1999).
Kirkeby et al., "Analysis of ill-conditioning of multi-channel deconvolution problems," Proc. 1999 IEEE Workshop on Applications of Signal Processing to Audio and Acoustics, pp. 155-158, Institute of Electrical and Electronics Engineers, New Paltz, New York (Oct. 17-20, 1999).
Kim et al., "Spatial resolution limits for the reconstruction of acoustic source strength by inverse methods," Journal of Sound and Vibration 265, pp. 583-608 (2003).
Farina et al., "AQT—a New Objective Measurement of the Acoustical Quality of Sound Reproduction in Small Compartments" Proceedings of the 110th AES Convention, Amsterdam, the Netherlands, pp. 1-7, Audio Engineering Society (May 12-15, 2001).
Binelli et al., "Digital equalization of automotive sound systems employing spectral smoothed FIR filters"—125 AES Convention, San Francisco (USA) (Oct. 2-5, 2008).
Kahana et al., "A multiple microphone recording technique for the generation of virtual acoustic images," J. Acoust. Soc. Am., vol. 105, No. 3, XP12000820, pp. 1503-1516, Acoustical Society of America (Mar. 1999).
Azzali et al., "AQTtool an automatic tool for design and synthesis of psychoacoustic Equalizers," 114th AES Convention, Amsterdam, the Netherlands, XP55384008, pp. 1-9, Audio Engineering Society (Mar. 22-25, 2003).

* cited by examiner

METHOD AND APPARATUS FOR CONTROLLING ACOUSTIC SIGNALS TO BE RECORDED AND/OR REPRODUCED BY AN ELECTRO-ACOUSTICAL SOUND SYSTEM

CROSS-REFERENCE TO RELATED APPLICATIONS

This application is a continuation of International Application No. PCT/EP2016/075033, filed on Oct. 19, 2016, the disclosure of which is hereby incorporated by reference in its entirety.

TECHNICAL FIELD

The present disclosure is directed to a method and apparatus for controlling acoustic signals to be captured or generated by an electro-acoustical sound system. Further, the present disclosure relates to a correspondingly arranged computer program product and to a correspondingly arranged computer-readable medium.

BACKGROUND

In the electronics field several applications exist for recording and reproducing acoustic signals, e.g. audio and/or video systems, telecommunication systems etc. For each of the applications an accurate recording and reproducing of the acoustic signals in a three-dimensional environment, i.e. room, in which shooting is taking place, is desired. This function is often implemented by means of digital equalizers.

When an acoustic signal source is employed for reproducing an acoustic signal in an enclosed room of limited dimensions, the acoustic signal produced by an electro-acoustical sound system (e.g., loudspeaker) interacts strictly with the sound field, and it is a complex task to separate the effects caused by the electro-acoustical sound system from the effects caused by the room. The smaller the room is, the stricter is this interaction. An example for a small room is a car comprising a sound system as the electro-acoustical sound system. Hence, an electro-acoustical sound system may produce in an anechoic room acoustic signals having a good or desired quality, while in a small room the electro-acoustical sound system produces acoustic signals having bad quality, and vice versa.

Similar effects occur, for example, also to the signals captured by a microphone inside a small room.

Thus, apparatuses and methods are required that automatically or nearly automatically adjust the recorded and/or reproduced signals such that they have a desired quality. Equalizers executing the corresponding equalization methods are used for adjusting the balance between frequency components within an acoustic signal. However, the known apparatuses and methods still leave room for improvements with regard to the quality of recorded and reproduced acoustic signals. Additionally, some of the known apparatuses and methods require a complicated manual fine tuning of variables used for the adjustment of the acoustic signals. In many cases, an acoustic signal adjustment method that is easy to handle fails to provide adjusted acoustic signals of satisfactory quality, while an acoustic signal adjustment method that provides satisfactory quality has a complicated handling.

SUMMARY

The object of the present disclosure is provision of an apparatus and method that improves the processing of acoustic signals recorded and/or reproduced by an electro-acoustical sound system (e.g., a loudspeaker, loudspeaker array, microphone, microphone array, mobile phone, smartphone, tablet, or any further device configured to capture or emit acoustic signals).

The object of the present disclosure is achieved by the solution provided in the enclosed independent claims. Advantageous implementations of the present disclosure are further defined in the respective dependent claims, in the description, and/or in the appended figures.

The present disclosure provides a method and an apparatus that improve considerably the quality of the recorded and/or reproduced acoustic signals. At the same time, a simple and efficient handling of the method and apparatus, both configured to control acoustic signals to be recorded and/or reproduced by an electro-acoustical sound system, is enabled. Moreover, the control of the acoustic signals to be recorded and/or reproduced by an electro-acoustical sound system and, particularly, the adjustment of the recorded and reproduced acoustic signals with regard to the desired quality can be executed automatically.

According to a first aspect, a method is provided, that is configured for controlling acoustic signals to be recorded and/or reproduced by an electro-acoustical sound system, wherein the method comprises the following steps: determining an initial digital filter by solving an inverse problem, wherein the initial digital filter is configured to control acoustic signals to be recorded and/or reproduced by the electro-acoustical sound system; determining a frequency-dependent articulation parameter by executing a time spectral psychoacoustic automatic audio quality test on the initial digital filter; tuning a frequency-dependent regularization parameter, used for determining the initial digital filter, by use of the frequency-dependent articulation parameter; and determining, by use of the tuned frequency-dependent regularization parameter, a digital filter configured to control acoustic signals to be recorded and/or reproduced by the electro-acoustical sound system.

The term "frequency-dependent" means that the values of the respective frequency-dependent articulation parameter and of the respective frequency-dependent regularization parameter are used to amend the frequencies of the recorded and/or reproduced acoustic signals and, thus, to improve the quality of the recorded and/or reproduced acoustic signals by adjusting their frequencies. Hence, said articulation parameter and said regularization parameter are determined, calculated, set, and/or adjusted in view or in dependence of the frequencies of the controlled acoustic signals and are, thus, frequency-dependent.

The initial digital filter is, for example, a known or conventional digital filter used for equalization.

In a first possible implementation according to the first aspect, the determining or the calculation of the frequency-dependent articulation parameter by executing the audio quality test to the initial digital filter comprises: executing a convolution of the initial digital filter with an acoustic test signal; and determining the frequency-dependent articulation parameter by determining a level of decay after a predetermined time interval between two consecutive bursts of the acoustic test signal.

In a second possible implementation form according to the first aspect as such or according to the first implementation form of the first aspect, the acoustic test signal comprises a repetition of bursts.

In a third possible implementation form according to the first aspect as such or according to the first or the second implementation form of the first aspect, the initial digital filter is determined by determining a least square solution to the inverse problem.

In a fourth possible implementation form according to the first aspect as such or according to the any of the preceding implementation forms of the first aspect, the tuned frequency-dependent regularization parameter is, up to an offset, a decreasing function of the articulation, the offset including a frequency-dependent regularization parameter determined when executing the determining of the initial digital filter.

In a fifth possible implementation form according to the first aspect as such or according to the any of the preceding implementation forms of the first aspect, the frequency-dependent regularization parameter is tuned as follows:

$$\beta_k = \beta_{Nelson,k} + \left(\beta_0 + \frac{\beta_1}{Art_k}\right)$$

wherein k denotes a k-th frequency index, wherein $\beta_0$ and $\beta_1$ are pre-set frequency-dependent regularization constants, wherein $Art_k$ is the frequency-dependent articulation parameter, and wherein $\beta_{Nelson}$ is the frequency-dependent regularization parameter employed when executing the determining of the initial digital filter. $\beta_{Nelson}$ is, for example, a conventional or traditional frequency-dependent regularization parameter. For example, $\beta_{Nelson}$ may be computed by the Nelson-Kirkeby-Farina approach, described, for example, in O. Kirkeby, P. A. Nelson, P. Rubak, A. Farina: "Design of Cross-talk Cancellation Networks by using Fast Deconvolution", 106$^{th}$ AES Convention, Munich, 8-11 May 1999, wherein the corresponding teaching of this publication is incorporated herein by reference.

In a sixth possible implementation form according to the first aspect as such or according to the any of the preceding implementation forms of the first aspect, the initial digital filter is an equalizing filter.

According to a second aspect, an apparatus is provided that is configured to control acoustic signals to be recorded and/or reproduced by an electro-acoustical sound system, wherein the apparatus comprises: an initial digital filter determining entity configured to determine an initial digital filter by solving an inverse problem, wherein the initial digital filter is configured to control acoustic signals to be recorded and/or reproduced by the electro-acoustical sound system; a frequency-dependent articulation parameter determining entity configured to determine a frequency-dependent articulation parameter by executing a time spectral psychoacoustic automatic audio quality test on the initial digital filter; a frequency-dependent regularization parameter tuning entity configured to tune a frequency-dependent regularization parameter, used for determining the initial digital filter, by use of the frequency-dependent articulation parameter; and a digital filter determining entity configured to determine, by use of the tuned frequency-dependent regularization parameter, a digital filter configured to control acoustic signals to be recorded and/or reproduced by the electro-acoustical sound system.

In a first possible implementation according to the second aspect, the frequency-dependent articulation parameter determining entity is configured to: execute a convolution of the initial digital filter with an acoustic test signal; and determine the frequency-dependent articulation parameter by determining a level of decay after a predetermined time interval between two consecutive bursts of the acoustic test signal.

In a second possible implementation form according to the second aspect as such or according to the first implementation form of the second aspect, the acoustic test signal comprises a repetition of bursts.

In a third possible implementation form according to the second aspect as such or according to the first or the second implementation form of the second aspect, the initial digital filter determining entity is configured to determine the initial digital filter by determining a least square solution to the inverse problem.

In a fourth possible implementation form according to the second aspect as such or according to the any of the preceding implementation forms of the second aspect, the tuned frequency-dependent regularization parameter is, up to an offset, a decreasing function of the articulation, the offset including a frequency-dependent regularization parameter determined when executing the determining of the initial digital filter.

In a fifth possible implementation form according to the second aspect as such or according to the any of the preceding implementation forms of the second aspect, the frequency-dependent regularization parameter tuning entity is configured to tune the frequency-dependent regularization parameter as follows:

$$\beta_k = \beta_{Nelson,k} + \left(\beta_0 + \frac{\beta_1}{Art_k}\right)$$

wherein k denotes a k-th frequency index, wherein $\beta_0$ and $\beta_1$ are pre-set regularization constants, wherein $Art_k$ is the frequency-dependent articulation parameter, and wherein $\beta_{Nelson}$ is the frequency-dependent regularization parameter employed when executing the determining of the initial digital filter. $\beta_{Nelson}$ is, for example, a conventional or traditional frequency-dependent regularization parameter. For example, $\beta_{Nelson}$ may be computed by the Nelson-Kirkeby-Farina approach, described, for example, in O. Kirkeby, P. A. Nelson, P. Rubak, A. Farina: "Design of Cross-talk Cancellation Networks by using Fast Deconvolution", 106$^{th}$ AES Convention, Munich, 8-11 May 1999, wherein the corresponding teaching of this publication is incorporated herein by reference.

In a sixth possible implementation form according to the second aspect as such or according to the any of the preceding implementation forms of the second aspect, the initial digital filter is an equalizing filter.

In a seventh possible implementation form according to the second aspect as such or according to the any of the preceding implementation forms of the second aspect, the apparatus is an equalizer or beamformer.

According to a third aspect, the present disclosure refers to a computer program product comprising computer readable program code that is configured to cause a computing device to execute steps of the method introduced above and explained in more detail below. According to a first possible implementation form according to the third aspect, the computer readable program code is embodied in a computer-readable medium. According to a second possible implementation form according to the first possible implementation form of the third aspect, the computer-readable medium is a non-transitory computer-readable medium. According to a third possible implementation form according to the third aspect as such or according to the first or second possible implementation form of the third aspect, the computing device is a processor or any other computer configured to execute computer readable program code.

According to a fourth aspect, the present disclosure relates to a computer-readable recording medium configured to store therein said computer program product. According to a first possible implementation form according to the fourth aspect, the computer-readable medium is a non-transitory computer-readable medium.

BRIEF DESCRIPTION OF THE DRAWINGS

The above-described aspects and implementation forms of the present disclosure will be explained in the following description of specific embodiments in relation to the enclosed drawings, in which.

DETAILED DESCRIPTION OF THE EMBODIMENTS

Figure 1:
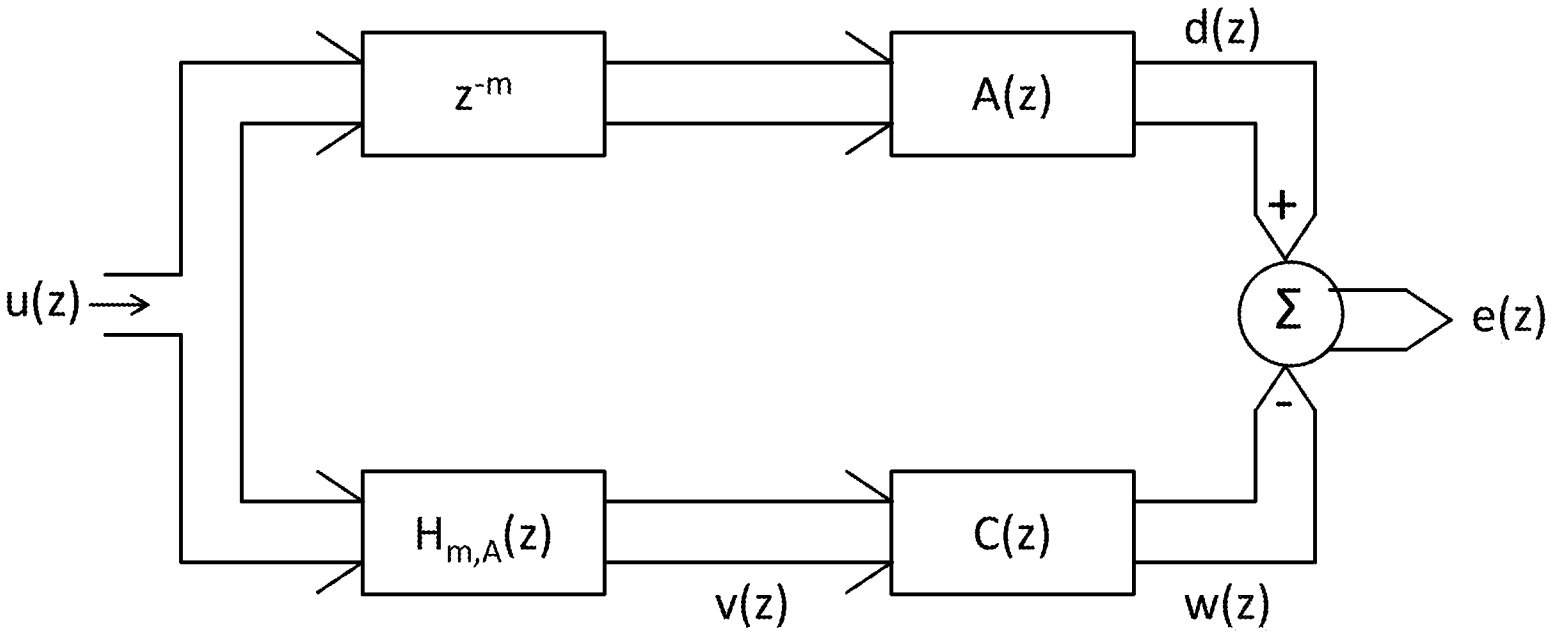
FIG. 1 shows a scenario of an inverse problem that is solved according to an embodiment of the present disclosure.

Generally, it has to be noted that all arrangements, devices, modules, components, models, elements, units, entities, and means and so forth described in the present application could be implemented by software or hardware elements or any kind of combination thereof. All steps which are performed by the various entities described in the present application as well as the functionality described to be performed by the various entities are intended to mean that the respective entity is adapted to or configured to perform the respective steps and functionalities. Even if in the following description of the specific embodiments, a specific functionality or step to be performed by a general entity is not reflected in the description of a specific detailed element of the entity which performs the specific step or functionality, it should be clear for a skilled person that these methods and functionalities can be implemented in respective hardware or software elements, or any kind of combination thereof. Further, the method of the present disclosure and its various steps are embodied in the functionalities of the various described apparatus elements.

Moreover, any of the embodiments and features of any of the embodiments, described herein, may be combined with each other, unless a combination is explicitly excluded.

The objective of the present disclosure is to provide a listener in a given "listening space" or room (e.g., living room) with an incident acoustic field that matches, as closely as possible in space and in time, that acoustic signal field which would have been incident upon the listener in the "recording space". Thus, it is desired to provide acoustic signals, to be recorded or reproduced by an electro-acoustical sound system (e.g., headphones, loudspeakers, microphones, etc.) into a "acoustical space" or room, such that they are as close as possible to recorded acoustic signals, i.e. acoustic signals that have been recorded but have not been recorded and/or reproduced by the electro-acoustical sound system. The recorded acoustic signals have still the quality that is desired for acoustic signals that are recorded and/or reproduced by the electro-acoustical sound system of the acoustic signals into the "listening space" or room, which adds to the recorded and/or reproduced acoustic signals undesired and disturbing noise.

As starting point is to undertake an analysis in the frequency domain. Thus, optimal acoustic signal outputs of one or more discrete acoustic sources are sought, which give, for example in the least squares sense, the "best fit" (in amplitude and/or phase) to a desired sound field. For generating the optimal acoustic signal outputs, one or more digital filters are selected from a set of filters for processing and, particularly, for filtering the acoustic signals to be output (i.e. to be recorded and/or reproduced) such that optimal acoustic signal outputs are obtained. Here, the term "optimal acoustic signal" means an acoustic signal that is as close as possible to the desired acoustic signal (usually referred as the "target"). Each one of the one or more digital filters has adjustable parameters, adjusting of which influences the result of the filtering by the respective filter.

Thus, a matrix of digital filters (i.e. one or more digital filters) is sought that can be used to control the outputs (i.e. recorded and/or reproduced acoustic signals) of the electro-acoustical sound system. As generally known, this is done by solving an inverse problem (see, for example, Yuvi Kahana, Philip A. Nelson, Ole Kirkeby, Hareo Hamada: "A multiple microphone recording technique for the generation of virtual acoustic images", J. Acoust. Soc. Am. 105 (3), March 1999, pp. 1503-1516).

FIG. 1 shows exemplary a scenario of an inverse problem that is solved according to an embodiment of the present disclosure. Given a set of S electro-acoustical sound systems (e.g., loudspeakers, etc.), the objective is to reproduce a desired sound field at R points in a listening room or space as accurately as possible. With regard to the scenario of FIG. 1 it is assumed that the system is working in discrete time. Therefore, the conventional z-transform notation is used. The variables are defined as follows. u(z) represents a vector of recorded acoustic signals, which are to be reproduced as closely as at the R points in the listening room or space. v(z) is a vector of S source input signals, w(z) is a vector of R reproduced acoustic signals, d(z) is a vector of R desired acoustic signals, and e(z) is a vector of R performance error signals. All vectors are column vectors written as:

$$u(z)=[U_1(z)\ \ldots\ U_T(z)]^T \tag{1}$$

$$v(z)=[V(z)\ \ldots\ V_S(z)]^T \tag{2}$$

$$w(z)=[W_1(z)\ \ldots\ W_R(z)]^T \tag{3}$$

$$d(z)=[D_1(z)\ \ldots\ D_R(z)]^T \tag{4}$$

$$e(z)=[E_1(z)\ \ldots\ E_R(z)]^T \tag{5}$$

The matrices A(z), C(z), and $H_{m,A}(z)$ represent multichannel digital filters. A(z) is an R×T target matrix, C(z) is an R×S plant matrix, and $H_{m,A}(z)$ is an S×T matrix of optimal filters. The component $z^{-m}$ delays all the elements of u by an integer number of m samples. This delay is usually referred to as modeling delay. The objective is to determine $H_{m,A}(z)$, and so the problem is essentially to invert C(z).

The matrix $H_{m,A}(z)$ of optimal digital filters, which are, in particular, optimal in the sense that they are constrained to be stable, but not constrained to be causal or of finite duration, is calculated, according to the present embodiment, with a least square solution to the inverse problem.

When considering the case when m=0 (no modeling delay), the digital filters to be used are obtained by solving the following inverse problem being a matrix inversion with regularization in frequency domain:

$$H_{0,A}(z)=[C^T(z^{-1})C(z)+\beta I]^{-1}C^T(z^1)A(z), \quad (6)$$

wherein I is an identity matrix of order S.

See with regard to the solving of the inverse problem, for example, the following publications: Yuvi Kahana, Philip A. Nelson, Ole Kirkeby, Hareo Hamada: "A multiple microphone recording technique for the generation of virtual acoustic images", J. Acoust. Soc. Am. 105 (3), March 1999, pp. 1503-1516; Ole Kirkeby, Philip A. Nelson, Hareo Hamada, Felipe Orduna-Bustamante: "Fast Deconvolution of Multichannel Systems Using Regularization", IEEE Transductions on Speech and Audio Processing, Vol. 6, No. 2, March 1998, pp. 189-194; Philip A. Nelson: "Active Control of Acoustic Fields and the Reproduction of Sound", Journal of Sound and Vibration (1994), 177(4), pp. 447-477; Ole Kirkeby, Per Rubak, Angelo Farina: "Analysis of Ill-Conditioning of Multi-Channel Deconvolution Problems", Proc. 1999 IEEE Workshop on Applications of Signal Processing to Audio and Acoustics, New Paltz, N.Y., Oct. 17-20, 1999, pp. 155-158. The whole disclosures of the above-listed publications are incorporated here by reference and explain in more detail the solving of the inverse problem (by means of a frequency-dependent regularization parameter β(z)) and the determining of the digital filters to be used for generating acoustic signals to be output (i.e. recorded and/or reproduced) by an electro-acoustical sound system.

When turning to the above equation (6), the term β(z) is a positive real number and represents a frequency-dependent regularization parameter that determines how much effort is required to minimize the error signal(s). By varying β from zero to infinity, the solution changes gradually from minimizing only the performance error to minimizing only the effort cost (see, for example, chapters III.A to III.C in Ole Kirkeby, Philip A. Nelson, Hareo Hamada, Felipe Orduna-Bustamante: "Fast Deconvolution of Multichannel Systems Using Regularization", IEEE Transductions on Speech and Audio Processing, Vol. 6, No. 2, March 1998, pp. 189-194). A large value of the frequency-dependent regularization parameter β means that the optimal solution will favor a low power output from the determined digital filters at the expense of a high performance error. Hence, the frequency-dependent regularization parameter β can be used to control the power output from the determined optimal digital filters. The frequency-dependent regularization parameter β can be used to control the "duration" of the optimal digital filters and, thereby, can provide a way to avoid the undesirable "warp-around" effect, which is usually associated with optimal filter design methods based on sampling in the frequency domain. It turns out that the regularization controls the longest time constant of the optimal digital filters, and in order to ensure that the value of this time constant is not too long or too short, the frequency-dependent regularization parameter β must be set appropriately. If the frequency-dependent regularization parameter β is too small, there will be sharp peaks in the frequency responses of the optimal digital filters, and if the frequency-dependent regularization parameter β is too large, the solution of the inverse problem will not be very accurate.

Thus, it is important to determine an appropriate frequency-dependent regularization parameter β. The present disclosure focuses in particular on finding of an appropriate frequency-dependent regularization parameter β, with a value which becomes larger at frequency where the articulation is poor.

Figure 2:
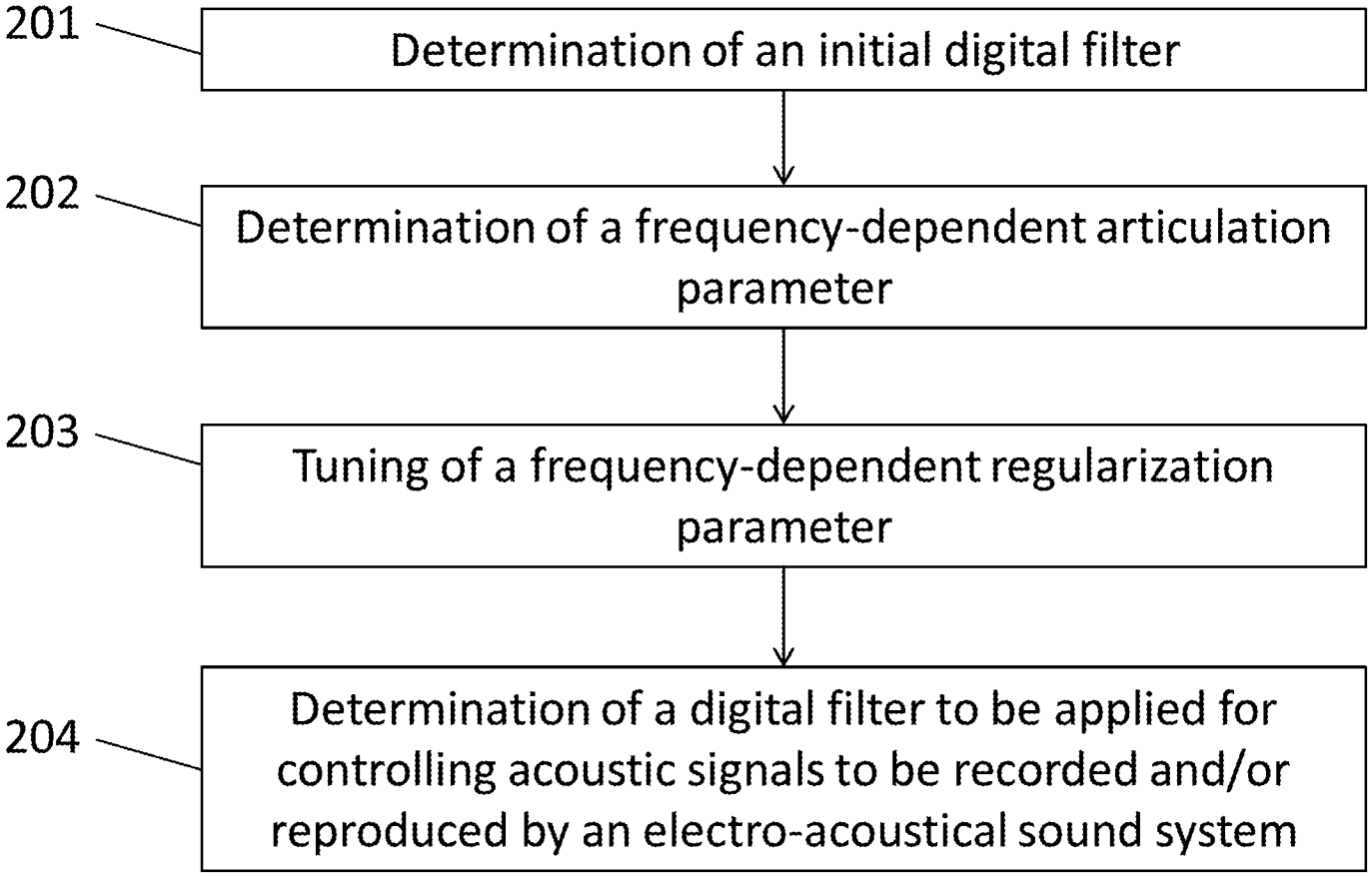
FIG. 2 shows steps executed for controlling acoustic signals to be recorded and/or reproduced by an electro-acoustical sound system according to an embodiment of the present disclosure.

FIG. 2 shows steps executed for controlling acoustic signals to be recorded and/or reproduced by an electro-acoustical sound system according to an embodiment of the present disclosure.

In step 201, one or more initial digital filters are determined by solving an inverse problem, wherein each one of the one or more initial digital filters is configured to control acoustic signals to be recorded and/or reproduced by the electro-acoustical sound system. The determining of the one or more initial digital filters is executed by use of an appropriate method for solving the inverse problem. According to an embodiment, the above-described equation (6) is used. The matrix $H_{0,A}(z)$ provides the one or more initial digital filters.

According to an embodiment, before executing step 201, a response of the electro-acoustical sound system is determined when recording acoustic signals via the electro-acoustical sound system. The determined response of the electro-acoustical sound system is then taken into consideration, when determining the one or more initial digital filters. The response is determined, for example, as being an inverted plant matrix C(z) mentioned above.

In step 202, a frequency-dependent articulation parameter is determined by executing a time spectral psychoacoustic automation audio quality test to the one or more initial digital filters determined in step 201. For this purpose, for each one of the one or more initial digital filters, a convolution of the respective initial digital filter with an acoustic test signal is executed and the frequency-dependent articulation parameter is determined by determining a level of decay after a predetermined time interval between two consecutive bursts of the acoustic test signal.

Figure 4:
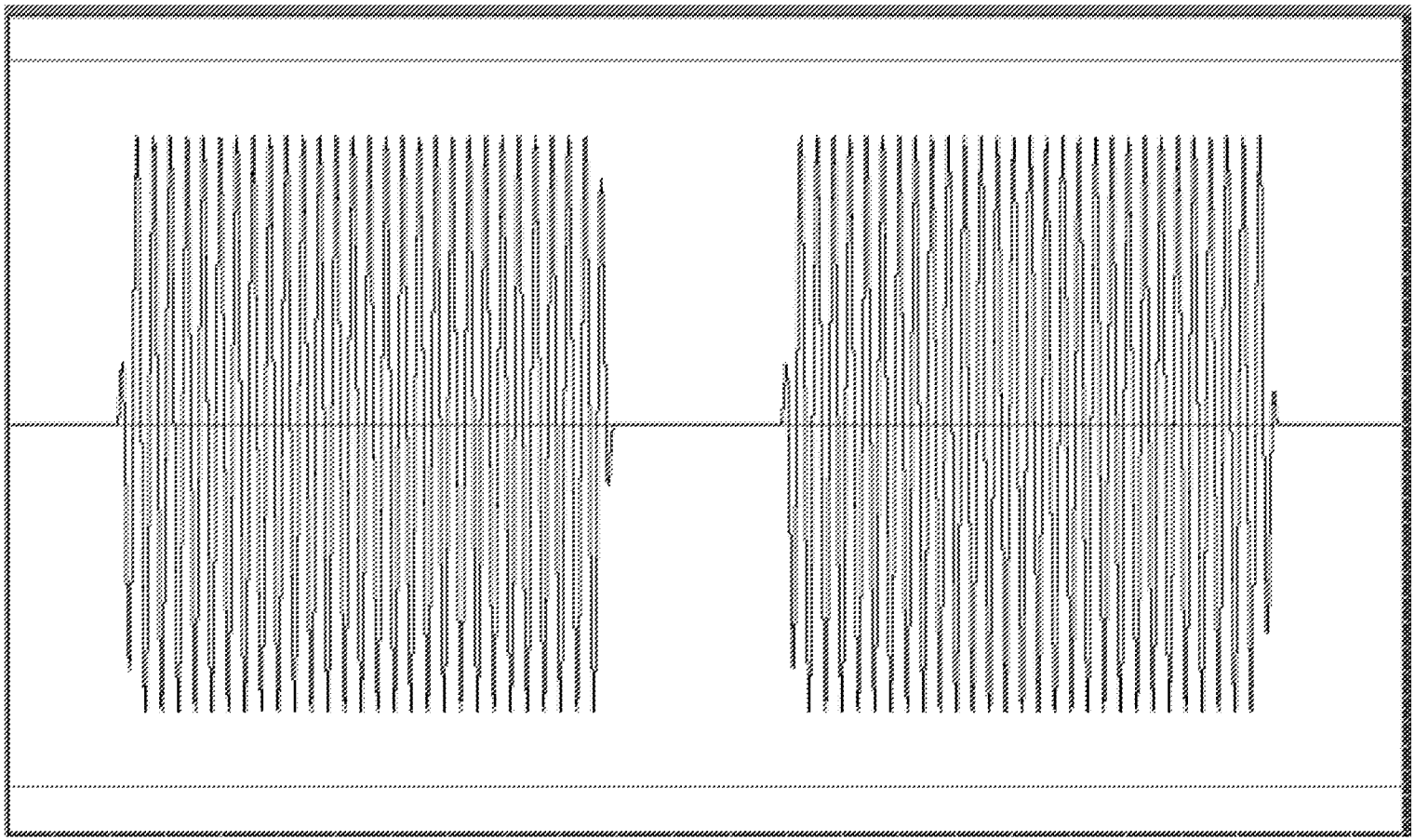
FIG. 4 shows an exemplary arrangement of an acoustical test signal according to an embodiment of the present disclosure.

According to the present embodiment, the acoustic test signal represents a repetition of bursts. The bursts are, for example, sinusoidal bursts. According to an exemplary embodiment, the acoustical test signal is a repetition of sinusoidal bursts, wherein each one of the bursts has a length of 200 ms and wherein two neighboring bursts have a space of 33 or 66 ms one after the other. This arrangement of the acoustical test signal is rather an exemplary arrangement, and, according to the present disclosure, also further appropriate arrangements of acoustical test signals are possible. FIG. 4 shows an exemplary arrangement of an acoustical test signal according to an embodiment of the present disclosure.

According to an embodiment, the frequency-dependent articulation parameter is determined by executing an AQT analysis, which is generally known. The AQT analysis is described, for example, in: Andrea Azzali, Alberto Bellini, Eraldo Carpanoni, Marco Romagnoli, Angelo Farina: "AQTool an automatic tool for design and synthesis of psychoacoustic Equalizers", 114$^{th}$ AES Convention, Amsterdam, 22-25 Mar. 2003; Angelo Farina, Gianfranco Cibelli, Alberto Bellini: "AQT—A New Objective Measurement Of The Acoustical Quality Of Sound Reproduction In Small Compartments", 110$^{th}$ AES Convention, Amsterdam, 12-15 May 2001. The whole disclosures of the above-listed publications are incorporated here by reference and explain in more detail the steps for executing the AQT analysis and for determining the frequency-dependent articulation parameter.

However, in the applications the AQT analysis is applied with regard to systems or electro-acoustical sound systems respectively, while, according to the present embodiment, the AQT analysis is executed with regard to the one or more initial digital filters. I.e. the acoustic test signal is fed to the one or more initial digital filters, and the AQT analysis is executed with regard to the processed or filtered acoustic test signal.

In step 203, a new frequency-dependent regularization parameter β is tuned by use of the frequency-dependent articulation parameter determined in step 202. According to the present embodiment, the tuned frequency-dependent regularization parameter β is, up to an offset, a decreasing function of the articulation, wherein the offset includes the regularization parameter β determined or used, respectively, when executing the determining of the initial digital filter (see the above equation (6) and the frequency-dependent regularization parameter β of the equation (6)). Particularly, the tuned frequency-dependent regularization parameter β is a decreasing function of the frequency-dependent articulation parameter determined in step 203. Thus, in step 203, an improved frequency-dependent regularization parameter β is determined.

According to an embodiment, the frequency-dependent regularization parameter β is tuned as follows:

$$\beta_k = \beta_{Nelson,k} + \left(\beta_0 + \frac{\beta_1}{Art_k}\right), \tag{7}$$

wherein k denotes a k-th frequency index, wherein $\beta_k$ denotes the tuned or improved frequency-dependent regularization parameter β (at k-th frequency), wherein $\beta_0$ and $\beta_1$ are pre-set regularization constants, wherein $Art_k$ is the frequency-dependent articulation parameter determined in step 202 (at k-th frequency), and wherein $\beta_{Nelson}$ is the frequency-dependent regularization parameter determined or used, respectively, when executing the determining of the initial digital filter (see the above equation (6) and the frequency-dependent regularization parameter β of the equation (6)). As mentioned above, $\beta_{Nelson}$ is, for example, a conventional or traditional frequency-dependent regularization parameter. For example, $\beta_{Nelson}$ may be computed by the Nelson-Kirkeby-Farina approach, described, for example, in O. Kirkeby, P. A. Nelson, P. Rubak, A. Farina: "Design of Cross-talk Cancellation Networks by using Fast Deconvolution", 106$^{th}$ AES Convention, Munich, 8-11 May 1999, wherein the corresponding teaching of this publication is incorporated herein by reference.

In this way, not only an improved frequency-dependent regularization parameter $\beta_k$ is determined, but also an automatic adaptation of the frequency-dependent regularization parameter β is enabled. This in turn leads to the possibility of an automatic control of acoustic signals to be recorded and/or reproduced by the electro-acoustical sound system.

According to an embodiment, $\beta_0$ and $\beta_1$ are constants. According to a further embodiment, $\beta_0$=0.01 and $\beta_1$=1. The values of $\beta_0$ and $\beta_1$ of this embodiment may be referred to as "typical" values used in known electro-acoustical sound systems.

In step 204, the tuned or improved frequency-dependent regularization parameter $\beta_k$ is used for determining of one or more digital filters, configured to control acoustic signals to be recorded and/or reproduced by the electro-acoustical sound system. The digital filter determining step 204 is executed, for example, in the same way as the initial digital filter determining step 201. Thus, for example, when one or more initial digital filters were determined in step 201 by use of the equation (6) and by use of an initial frequency-dependent regularization parameter $\beta_{Nelson}$, in step 204, the determining of digital filters is executed again by use of the equation (6), however, with an improved or tuned frequency-dependent regularization parameter $\beta_k$. In this way, an optimization and improvement of the quality of the acoustic signals, recorded and/or reproduced by the electro-acoustical sound system, is achieved. The recorded and/or reproduced acoustic signals are narrowed to the desired acoustic signals. As explained above, this optimization or improving of the quality of the recorded and/or reproduced acoustic signals can be executed also in an automatic way such that besides the optimization of the quality of the recorded and/or reproduced acoustic signals also the handling of the adjustment of the acoustic signals to be outputted is simplified. In this way, an efficient adjustment of acoustic signals to be recorded and/or reproduced by the electro-acoustical sound system with high quality of recorded and/or reproduced acoustic signals is enabled.

Figure 3:
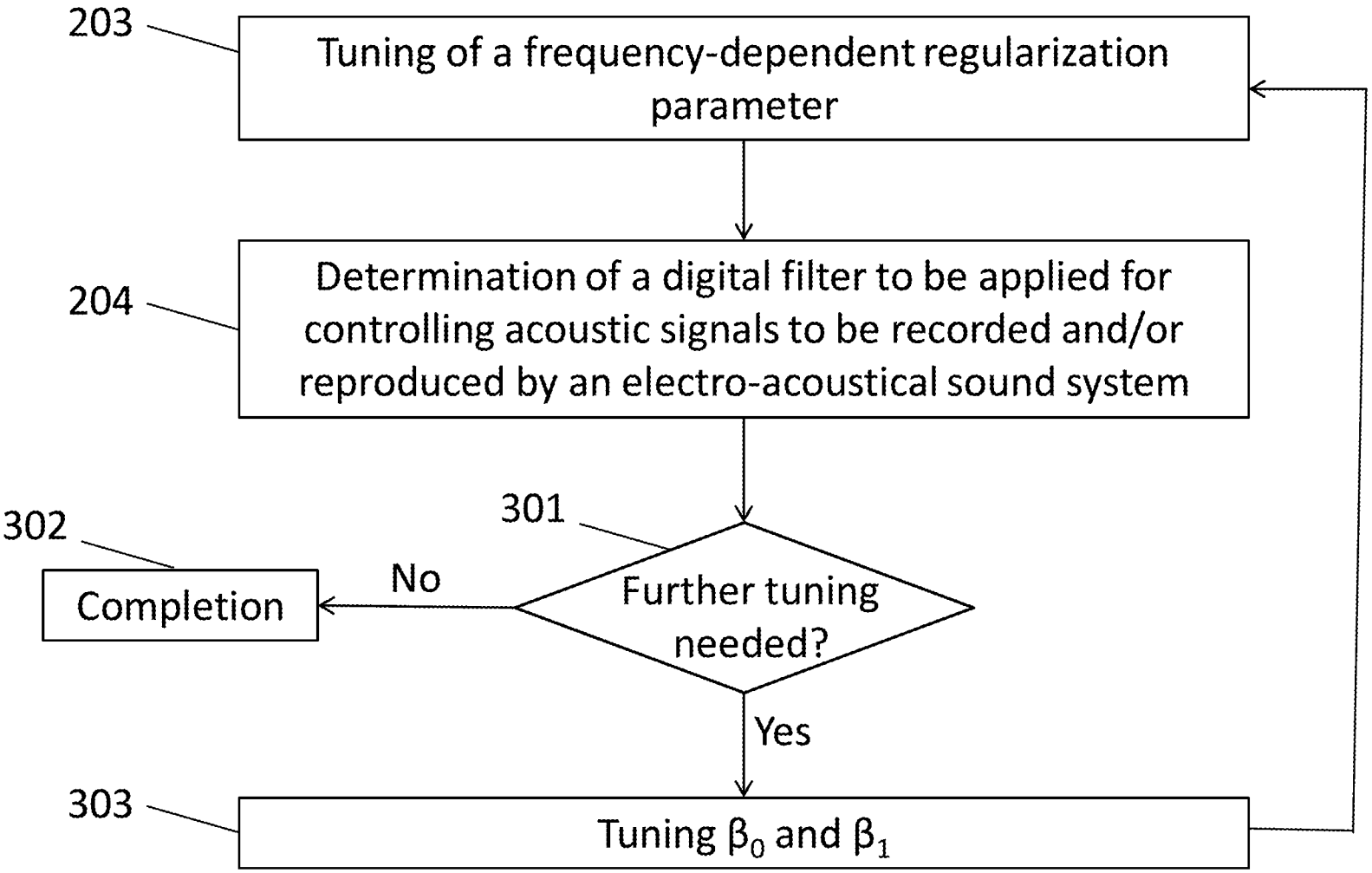
FIG. 3 shows further steps executed for controlling acoustic signals to be recorded and/or reproduced by an electro-acoustical sound system according to an embodiment of the present disclosure.

Additionally, according to a further embodiment of the present disclosure, a further improvement of the quality of the acoustic signals to be recorded and/or reproduced by the electro-acoustical sound system can be executed by repeating the execution of the steps 203 and 204. This is shown in FIG. 3, wherein the embodiment of FIG. 3 supplements the embodiment of FIG. 2. According to FIG. 3, after the execution of the step 204, it is verified 301 whether a further scaling or tuning of the frequency-dependent regularization parameter β is required. If no further scaling or tuning of the frequency-dependent regularization parameter β is required, the determining of the digital filters is finished, i.e. the digital filters determined in step 204 will be used for generating recorded and/or reproduced acoustic signals by the acoustic signal determining device, and the execution of the method is completed. If further scaling or tuning of the frequency-dependent regularization parameter β is required, the frequency-dependent regularization parameters $\beta_0$ and $\beta_1$ are adjusted in step 303, i.e. other values of the frequency-dependent regularization parameters $\beta_0$ and $\beta_1$ are used, which also may be preset. Subsequently, steps 203 and 203 are executed again, wherein the value of the frequency-dependent regularization parameter $\beta_{Nelson}$ is now the value of the frequency-dependent regularization parameter $\beta_k$ determined previously in step 203. Thus, the improvement of the value of the frequency-dependent regularization parameter $\beta_k$ is continued until the desired quality of the acoustic signals recorded and/or reproduced by the electro-acoustical sound system has been reached (as far as possible).

Figure 5:
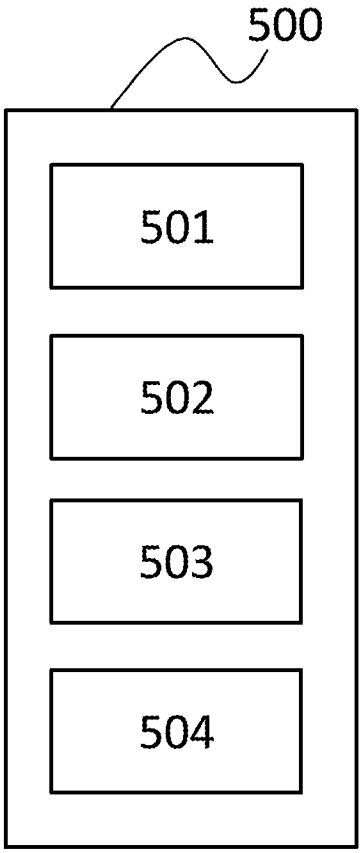
FIG. 5 shows an exemplary arrangement of an apparatus configured to control acoustic signals to be recorded and/or reproduced by an electro-acoustical sound system according to an embodiment of the present disclosure.

FIG. 5 shows an exemplary arrangement of an apparatus 500 configured to control acoustic signals to be recorded and/or reproduced by an electro-acoustical sound system according to an embodiment of the present disclosure.

According to the present embodiment, the apparatus 500 comprises an initial digital filter determining entity 501 configured to determine an initial digital filter by solving an inverse problem, wherein the initial digital filter is configured to control acoustic signals to be recorded and/or reproduced by the electro-acoustical sound system. In particular, the initial digital filter determining entity 501 is configured to execute step 201 as described above. The apparatus 500 comprises a frequency-dependent articulation parameter determining entity 502 configured to determine a frequency-dependent articulation parameter by executing a time spectral psychoacoustic automatic audio quality test on the initial digital filter. In particular, the frequency-dependent articulation parameter determining entity 502 is configured to execute step 202 as described above. The apparatus 500 comprises a frequency-dependent regularization parameter tuning entity 503 configured to tune a frequency-dependent regularization parameter, used for determining the initial digital filter, by use of the frequency-dependent articulation parameter. In particular, the frequency-dependent regularization parameter tuning entity 503 is configured to execute step 203 as described above. The apparatus 500 comprises a digital filter determining entity 504 configured to determine, by use of the tuned frequency-dependent regularization parameter, a digital filter configured to control acoustic signals to be recorded and/or reproduced by the electro-acoustical sound system. In particular, the digital filter determining entity 504 is configured to execute the step 204 as described above. According to a further embodiment, the apparatus 500 is configured to execute also the steps 301 to 303, described above with regard to FIG. 3. Here, for example, the frequency-dependent regularization parameter tuning entity 503 is configured to execute the additional steps 301 to 303 for improving the quality of the acoustic signals recorded and/or reproduced by the electro-acoustical sound system.

Further, according to an embodiment, the apparatus 500 is an equalizer.

Thus, the relates to a method and to an apparatus, both arranged for controlling acoustic signals to be recorded and/or reproduced by an electro-acoustical sound system. For this purpose: an initial digital filter is determined by solving an inverse problem, wherein the initial digital filter is configured to control acoustic signals to be recorded and/or reproduced by the electro-acoustical sound system; a frequency-dependent articulation parameter is determined by executing a time spectral psychoacoustic automatic audio quality test on the initial digital filter; a frequency-dependent regularization parameter, used for determining the initial digital filter, is tuned by use of the frequency-dependent articulation parameter; and, by use of the tuned frequency-dependent regularization parameter, a digital filter configured to control acoustic signals to be recorded and/or reproduced by the electro-acoustical sound system is determined.

It has to be noted that any of the embodiments and features of any of the embodiments, described herein, may be combined with each other, unless a combination is explicitly excluded.

The disclosure has been described in conjunction with various embodiments herein. However, other variations to the enclosed embodiments can be understood and effected by those skilled in the art and practicing the claimed disclosure, from a study of the drawings, the disclosure and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

What is claimed is:

1. A method, comprising:

determining, by a computing device, an initial digital filter by solving an inverse problem, wherein the initial digital filter is configured to control acoustic signals to be recorded and/or reproduced by an electro-acoustical sound system;

determining, by the computing device, a frequency-dependent articulation parameter based on a time spectral psychoacoustic automatic audio quality test on the initial digital filter;

tuning, by the computing device, a frequency-dependent regularization parameter used for determining the initial digital filter based on the frequency-dependent articulation parameter; and determining, by the computing device, a digital filter configured to control the acoustic signals to be recorded and/or reproduced by the electro-acoustical sound system based on the tuned frequency-dependent regularization parameter.

2. The method according to claim 1, wherein the determining the frequency-dependent articulation parameter comprises:

executing a convolution of the initial digital filter with an acoustic test signal; and determining the frequency-dependent articulation parameter based on determining a level of decay after a predetermined time interval between two consecutive bursts of the acoustic test signal.

3. The method according to claim 2, wherein the acoustic test signal comprises a repetition of bursts.

4. The method according to claim 1, wherein the determining the initial digital filter comprises determining a least square solution to the inverse problem.

5. The method according to claim 1, wherein the tuned frequency-dependent regularization parameter is, up to an offset, a decreasing function of the frequency-dependent articulation parameter, the offset including a frequency-dependent regularization parameter that is determined as a result of the determining of the initial digital filter.

6. The method according to claim 1, wherein the frequency-dependent regularization parameter is tuned as follows:

$$\beta_k = \beta_{Nelson,k} + \left(\beta_0 + \frac{\beta_1}{Art_k}\right),$$

wherein k denotes a k-th frequency index, wherein $\beta_0$ and $\beta_1$ are pre-set frequency-dependent regularization constants, wherein $Art_k$ is the frequency-dependent articulation parameter, and wherein $\beta_{Nelson,k}$ is the frequency-dependent regularization parameter employed when executing the determining of the initial digital filter.

7. The method according to claim 1, wherein the initial digital filter is an equalizing filter.

8. An apparatus, comprising:

a computer-readable medium configured to store computer readable program code; and a processor configured to execute the computer readable program code to cause the apparatus to:

determine an initial digital filter by solving an inverse problem, wherein the initial digital filter is configured to control acoustic signals to be recorded and/or reproduced by an electro-acoustical sound system;

determine a frequency-dependent articulation parameter based on a time spectral psychoacoustic automatic audio quality test on the initial digital filter;

tune a frequency-dependent regularization parameter used for determining the initial digital filter based on the frequency-dependent articulation parameter; and determining a digital filter configured to control the acoustic signals to be recorded and/or reproduced by the electro-acoustical sound system based on the tuned frequency-dependent regularization parameter.

9. The apparatus according to claim 8, wherein the determining the frequency-dependent articulation parameter comprises:

executing a convolution of the initial digital filter with an acoustic test signal; and determining the frequency-dependent articulation parameter based on determining a level of decay after a predetermined time interval between two consecutive bursts of the acoustic test signal.

10. The apparatus according to claim 9, wherein the acoustic test signal comprises a repetition of bursts.

11. The apparatus according to claim 8, wherein the determining the initial digital filter comprises determining a least square solution to the inverse problem.

12. The apparatus according to claim 8, wherein the tuned frequency-dependent regularization parameter is, up to an offset, a decreasing function of the frequency-dependent articulation parameter, the offset including a frequency-dependent regularization parameter that is determined as a result of the determining of the initial digital filter.

13. The apparatus according to claim 8, wherein the tuning the frequency-dependent regularization parameter comprises tuning the frequency-dependent regularization parameter as follows:

$$\beta_k = \beta_{Nelson,k} + \left(\beta_0 + \frac{\beta_1}{Art_k}\right),$$

wherein k denotes a k-th frequency index, wherein $\beta_0$ and $\beta_1$ are pre-set frequency-dependent regularization constants, wherein $Art_k$ is the frequency-dependent articulation parameter, and wherein $\beta_{Nelson,k}$ is the frequency-dependent regularization parameter employed when executing the determining of the initial digital filter.

14. The apparatus according to claim 8, wherein the initial digital filter is an equalizing filter.

15. The apparatus according to claim 8, wherein the apparatus is an equalizer or beamformer.

16. A non-transitory computer-readable recording medium configured to store therein a computer program product, which comprises a computer readable program code that is configured to cause a computing device to execute steps comprising:

determining an initial digital filter by solving an inverse problem, wherein the initial digital filter is configured to control acoustic signals to be recorded and/or reproduced by an electro-acoustical sound system;

determining a frequency-dependent articulation parameter based on a time spectral psychoacoustic automatic audio quality test on the initial digital filter;

tuning a frequency-dependent regularization parameter used for determining the initial digital filter based on the frequency-dependent articulation parameter; and determining a digital filter configured to control the acoustic signals to be recorded and/or reproduced by the electro-acoustical sound system based on the tuned frequency-dependent regularization parameter.

17. The computer-readable recording medium according to claim 16, wherein the determining the frequency-dependent articulation parameter comprises:

executing a convolution of the initial digital filter with an acoustic test signal; and determining the frequency-dependent articulation parameter based on determining a level of decay after a predetermined time interval between two consecutive bursts of the acoustic test signal.

18. The computer-readable recording medium according to claim 17, wherein the acoustic test signal comprises a repetition of bursts.

19. The computer-readable recording medium according to claim 16, wherein the determining the initial digital filter comprises determining a least square solution to the inverse problem.

20. The computer-readable recording medium according to claim 16, wherein the tuned frequency-dependent regularization parameter is, up to an offset, a decreasing function of the frequency-dependent articulation parameter, the offset including a frequency-dependent regularization parameter that is determined as a result of the determining of the initial digital filter.

* * * * *